US006103334A

United States Patent [19]

Gruber, Sr.

[11] Patent Number: 6,103,334

[45] Date of Patent: Aug. 15, 2000

[54] THERMOPLASTIC CURTAIN WALL SYSTEM

[75] Inventor: Alois Gruber, Sr., Bad Hall, Austria

[73] Assignee: AGRU Kunststofftechnik GmbH, Bad Hall, Austria

[21] Appl. No.: 09/145,186

[22] Filed: Sep. 1, 1998

Related U.S. Application Data

[60] Provisional application No. 60/086,224, May 21, 1998.

[51] Int. Cl.[7] ..... B32B 3/06

[52] U.S. Cl. ..... 428/99; 428/57; 428/119; 24/587

[58] Field of Search ..... 428/57, 58, 60, 428/192, 119, 99; 24/587, 306, DIG. 11; 383/63

[56] References Cited

U.S. PATENT DOCUMENTS

| | | | |
|---|---|---|---|
| 2,020,315 | 11/1935 | Hughes . | |
| 4,842,095 | 6/1989 | Stech . | |
| 4,849,268 | 7/1989 | Backenstow et al. . | |
| 4,854,017 | 8/1989 | Kamp | 383/63 |
| 5,084,119 | 1/1992 | Barksdale . | |
| 5,254,661 | 10/1993 | Wilson . | |
| 5,351,369 | 10/1994 | Swain . | |
| 5,476,699 | 12/1995 | Hurvitz et al. . | |
| 5,497,097 | 3/1996 | Walling et al. . | |
| 5,660,912 | 8/1997 | Menzel . | |
| 5,662,974 | 9/1997 | Andrenacci et al. . | |

FOREIGN PATENT DOCUMENTS

| | | |
|---|---|---|
| 624 960 | 1/1936 | Germany . |
| 1145325 | 3/1969 | United Kingdom . |
| 2278623 | 7/1994 | United Kingdom . |

OTHER PUBLICATIONS

Print–out of world wide web site found at http://www.curtisbarrier.com/product/geolock.html showing "Geolock" brand vertical cut–off wall system; dated Mar. 6, 1998.

*Primary Examiner*—Alexander Thomas
*Attorney, Agent, or Firm*—Anthony J. Casella; Gerald E. Hespos

[57] ABSTRACT

A thermoplastic curtain wall system is provided for forming a vertical curtain wall from a plurality of wall sections. Each of the wall sections includes a rectangular thermoplastic panel to which at least one locking strip is fused to. The locking strip is formed with two generally dovetail shaped locking members, a channel and a locking lip. In joining two of the wall sections, the locking strips of adjoining wall sections are homogamously interlocked to form connecting joints. Spaces are defined in the joint for accommodating sealant material.

15 Claims, 2 Drawing Sheets

THERMOPLASTIC CURTAIN WALL SYSTEM

This application claims priority of U.S. Provisional Patent Appl. No. 60/086,224, filed May 21, 1998.

BACKGROUND OF THE INVENTION

This invention relates to joining of thermoplastic liners and, more particularly, to mechanical connections for joining sheets of thermoplastic liners.

It is known in the prior art to use lined trenches to contain contaminated materials. After a suitable trench is excavated, a layer of an impermeable material, often a bentonite/cement slurry, is disposed in the trench. Thereafter, vertical thermoplastic curtain walls are forced into the impermeable layer and propped against the vertical walls of the trench to prevent transverse seepage of contaminants into the surrounding soil.

Different curtain wall designs are known in the prior art. Once such design is manufactured by Geotechnics Holland BV and sold under the tradename "GEOLOCK". With the "GEOLOCK" system, adjoining wall sections are secured together through a "tongue and groove" locking system which includes cooperating male and female locking members. Each wall section is formed with a rectangular panel to which a male locking member is welded along one longitudinal edge thereof and a female locking member along the other longitudinal edge thereof. In forming the curtain wall, a first wall section is slipped vertically into the trench, with consecutive wall sections being sequentially slipped into the trench with the locking members being engaged. Also, a single bead of sealant material is disposed in each of the locking joints to seal the respective joints.

This system, however, suffers from some drawbacks. First, two different types of locking members, male and female, must be provided for the system. The locking members are formed separately from the thermoplastic panels and, thus, two separate inventories of the male and female locking members must be maintained. Also, some care must be taken to ensure a male locking member and a female locking member are arranged to cooperate at each joint. A second drawback of the system is that only a single bead of hydrophilic rubber may be disposed in each of the locking joints.

A second type of curtain wall system is shown in U.S. Pat. No. 5,497,097 to Walling, et al., issued Mar. 5, 1996 and entitled "APPARATUS FOR DETECTING A CONNECTION BETWEEN ADJACENT PANELS OF A CURTAIN WALL". With this system, homogamous locking members are provided with each having protruding T-shaped locking elements which are formed to interlock. In forming a joint, the T-shaped elements are interdigitated and a plurality of beads of sealant material are disposed between the various T-shaped locking elements. The interconnection of the T-shaped elements alone, however, does not completely restrict relative movement of the joined locking members since the interdigitated T-shaped locking elements are spaced apart. The sealant material is not only used to seal the locking joint but is also required to provide stability to the joint.

It is an object of the subject invention to provide a thermoplastic curtain wall system formed with homogamous locking strips which provide stable, rigid interconnections between adjoining wall sections.

It is another object of the subject invention to provide a thermoplastic curtain wall system having wall sections connected by joints which can accommodate more than one bead of sealant material.

SUMMARY OF THE INVENTION

The aforementioned objects are met by a thermoplastic curtain wall system formed by a plurality of curtain wall sections, each wall section including a thermoplastic panel and being interconnected by thermoplastic homogamous locking strips. The locking strips are each formed with two generally dovetail shaped locking members.

The thermoplastic panels are generally rectangular in shape and formed to extend into a trench which is to be lined by the curtain wall system of the subject invention. To ensure the panels are of sufficient rigidity, it is preferred that the panels be formed with a width equal to or less than 22.5 feet. The panels are preferably cut lengths of an extruded geomembrane which is resistant to the contaminants which are to be contained.

The locking strips are extruded, elongated elements which are preferably formed with a constant cross-section throughout. Each of the locking strips is identically formed and shaped to homogamously lock with a second locking strip. An elongated, planar base is formed in each of the locking strips from which the locking members extend. First and second shoulders also extend upwardly from the longitudinal edges of the base. An elongated, planar attaching member extends from the first shoulder which is parallel to, but not coplanar with, the base. A generally J-shaped rim also extends from the first shoulder, wherein the rim, the first shoulder, and a portion of the base collectively define a channel. A locking lip extends outwardly from the second shoulder. In forming a wall section, a locking strip is provided along the longitudinal edge of each of the panels, as required. Specifically, the attaching member of the locking strip is fused, using techniques known by those skilled in the art, to the panel.

In forming a curtain wall, a first wall section is oriented with the locking strip being generally perpendicular to the longitudinal axis of a trench to be lined and lowered therein. Consecutive wall sections are oriented in a similar fashion and lowered into the trench with the locking strips of adjoining wall sections coming into engagement. Particularly, the dovetail locking members of the locking strips are caused to be slid into dovetailed intermeshing engagement. Also, the locking lip of each locking strip is slid into the channel formed in the corresponding engaged locking strip. Additionally, one or two beads of a sealant material, preferably hydrophilic rubber, may be disposed in each of the joints formed by the locking strips. Hydrophilic rubber expands upon contact with water and ensures a tight seal in the joint. As is readily apparent, the intermeshing dovetailed connections and the interengagement of the locking lips and channels between interengaged locking strips provide for stable joints which essentially restrict the movement of the interengaged locking strips to one degree of freedom—only in directions parallel to the longitudinal axes of the locking strips, but not in any directions perpendicular thereto.

These and other features of the invention will be better understood through a study of the following detailed description and accompanying drawings.

DETAILED DESCRIPTION OF THE INVENTION

Figures 1, 3:
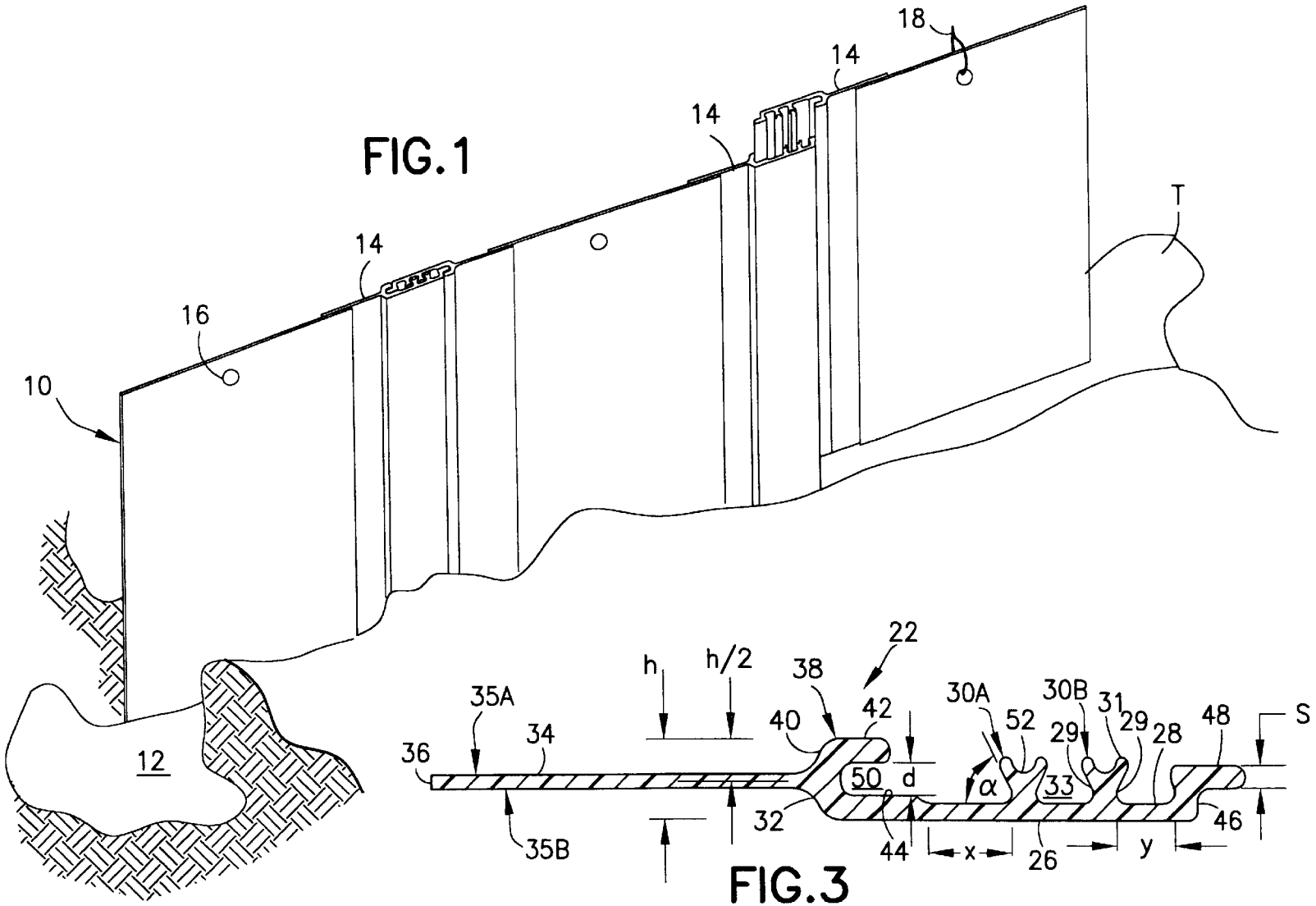
FIG. 1 is a perspective view of a curtain wall of the subject invention.
FIG. 3 is a cross-sectional view of a locking strip of the subject invention.

FIG. 1 generally s hows a thermoplastic curtain wall 10 for lining a trench T which may accommodate contaminants. A layer of impermeable material 12, such as a bentonite/cement slurry, is typically disposed along the bottom of the trench T to prevent seepage of the contaminants into soil located at the bottom on the trench T. The curtain wall 10 is formed from a plurality of curtain wall sections 14 which are joined together as described below. To facilitate assembly of the curtain wall 10, an aperture 16 may be formed through the respective wall sections 14 to which a hoisting device 18 may be attached. The hoisting device 18 advantageously simultaneously bears the load of the respective wall section 14 and slowly lowers the wall section 14 into the trench T, thereby allowing an operator to observe the interengagement of each pair of wall sections 14 during assembly and to ensure a proper joint is formed therebetween.

Figure 2:
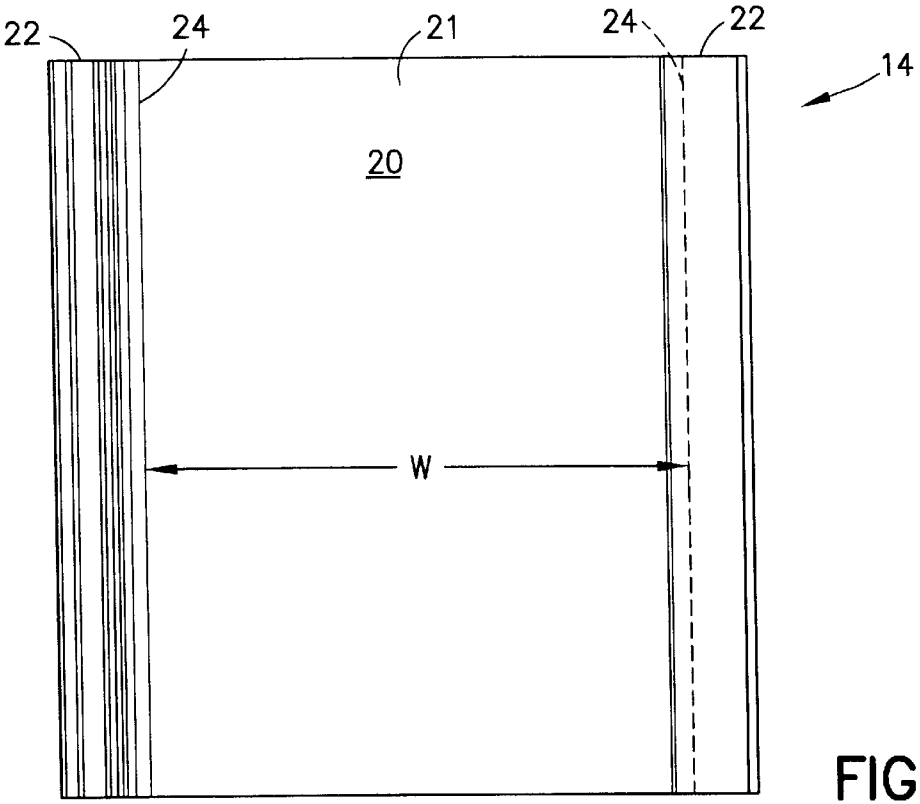
FIG. 2 is a front view of a curtain wall section of the subject invention.

Referring to FIG. 2, a representative wall section 14 is shown therein. The wall section 14 includes a thermoplastic panel 20 and locking strips 22. The thermoplastic panel 20 is preferably a length of a flat, extruded high density polyethylene geomembrane having opposing panel surfaces 21. The panel 20 has a thickness in the range of 60–100 mils, wherein the panel 20 is generally rectangular and has two longitudinal edges 24 which are spaced apart by a distance "w". Preferably, the distance "w" is not greater than 22.5 feet.

The locking strips 22 are fused to the panel 20 as described below. As shown in FIG. 2, the locking strips 22 may be joined to the panel 20 to have opposing orientations. Specifically, the locking strip 22 on the left-hand side of the panel 20 is shown to face frontward, whereas, the locking strip 22 on the right-hand side of the panel 20 is shown to face rearward. Alternatively, the locking strips 22 may be arranged with a common orientation. Furthermore, the wall section 14 which defines the beginning or end of the curtain wall 10 need only be formed with one of the locking strips 22 accordingly.

The locking strips 22 are formed from a thermoplastic material, preferably high density polyethylene, and shaped by an extruding process to have a constant cross-section throughout. FIG. 3 depicts the cross-section of a representative locking strip 22. The locking strip 22 is formed with a generally planar base 26 having a top surface 28 from which first and second generally dovetail shaped locking members 30A, 30B extend. The locking members 30A, 30B are both generally straight throughout the length thereof and formed with the same cross-sectional shape and dimensions. Each of the locking members 30A, 30B is formed with two sidewalls 29 and a top surface 31. The sidewalls 29 define an acute angle a relative to the base 26.

The locking members 30A, 30B are formed to be parallel to the edges of the base 26, with the locking members 30A, 30B being spaced-apart to define a channel 33 therebetween. The channel 33 is shaped and dimensioned to accommodate one of the locking members 30A, 30B in an interlocking dovetailed relationship as described below. A first upstanding, shoulder 32 extends from the base 26, and a generally planar attaching member 34 extends outwardly from the shoulder 32 to define first and second attaching surfaces 35A and 35B, respectively, and an edge 36. Preferably, the attaching member 34 is parallel to the base 26, but offset therefrom. As shown in FIG. 3, the attaching member 34 is located centrally on the locking strip 22, wherein the overall height of the locking strip 22 is "h" and the attaching member is disposed to be at one half the length of "h".

Further referring to FIG. 3, a generally J-shaped rim 38 also extends from the first shoulder 32 having a curved portion 40 and a generally straight stem 42. The base 26 is formed with a planar raised portion 44, which is in partial face-to-face alignment with the stem 42 of the rim 38 and spaced therefrom a distance "d". A second shoulder 46 extends upwardly from the base 26 from which a planar locking lip 48 extends having a thickness "s". The locking lip 48 is preferably formed to be parallel to the base 26. The raised portion 44 of the base 26, the first shoulder 32 and the rim 38 collectively define a locking lip receiving channel 50. The distance "d" defines the width of the channel 50 and the width "d" must be at least as great as the thickness "s" of the locking lip 48. In the preferred embodiment, the stem 42 of the rim 38 is formed to be parallel to the raised portion 44.

The first locking member 30A must be spaced from the raised portion 44 a distance "x". The distance "x" must be at least great enough to allow for accommodation of one of the locking members 30A, 30B. In a preferred arrangement, the distance "x" is great enough to accommodate one of the locking members 30A, 30B and a bead of sealant material. The second locking member 30B is preferably spaced from the second shoulder 46 a distance "y" which is sufficient to accommodate a bead of sealant material. To reduce the amount of material necessary to form the locking strip 22, portions of the locking strip 22 may be strategically hollowed out or thinned. For example, troughs 52 may be formed into the top surfaces 31 of the locking members 30A, 30B.

Figure 4:
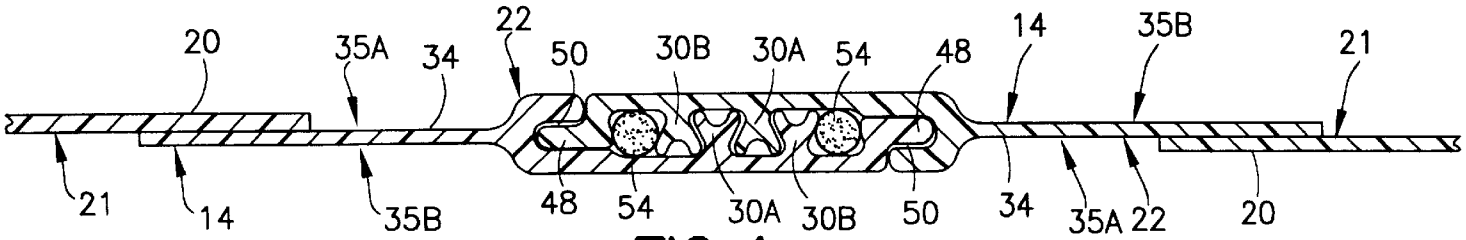
FIG. 4 is a cross-sectional view of a joint of the subject invention.

The locking strips 22 are secured to the panels 20 by joining one of the first and second attaching surfaces 35A, 35B to one of the panel surfaces 21 using any technique known by those skilled in the art, such as fusing. As shown in FIG. 4, the attaching surfaces 35A are joined in face-to-face engagement with the panel surfaces 21 to provide rigidity to the joined panels 20 and the locking strips 22.

FIG. 4 shows two of the wall sections 14 being connected with the respective locking strips 22 being homogamously interlocked. Specifically, the respective locking lips 48 are disposed in the locking lip receiving channels 50, and the locking members 30A and 30B are in dovetailed meshing interengagement, with the sidewalls of the locking members 30A and 30B being in face-to-face engagement as shown. Beads of sealant material 54 are disposed within the joint between the respective second locking member 30B and the second shoulder 46 of each of the locking strips 22. Preferably, the sealant material is hydrophilic rubber. Alternatively, only one of the two beads 54 shown in FIG. 4 may be utilized. As is readily apparent, the combination of the interengagement of the locking lips 48 with the channels 50 and the dovetail intermeshing of the locking members 30A, 30B substantially restricts relative movement between the locking strips 22 in directions parallel to the plane of FIG. 4. The locking joint shown in FIG. 4 allows movement in essentially only one degree of freedom—in directions perpendicular to the plane of FIG. 4.

As is readily apparent, numerous modifications and changes may readily occur to those skilled in the art, and hence it is not desired to limit the invention to the exact construction and operation shown and described, and, accordingly, all suitable modification equivalents may be resorted to falling within the scope of the invention as claimed.

What is claimed is:

1. A thermoplastic locking strip for being fused to a thermoplastic panel and for forming a connection for a curtain wall, said locking strip comprising an elongated rectangular base, said base having spaced-apart first and second longitudinal edges and a top surface extending therebetween, and at least two generally dovetail shaped locking members being unitarily formed with and extending from said top surface of said base, wherein each said locking member is generally straight and parallel to at least one of said longitudinal edges, said dovetail shaped locking members being substantially cross-sectionally identical to one another and being spaced apart to define a channel therebetween, said channel defining a dovetail cross-sectionally shape substantially identical to the dovetail shape of the locking members, such that said channel may slideably receive a dovetail shaped locking member of an identical thermoplastic locking strip.

2. A locking strip as in claim 1, wherein each said locking member extends coextensively with said base.

3. A thermoplastic locking strip for being fused to a thermoplastic panel and for forming a connection for a curtain wall, said locking strip comprising an elongated rectangular base, said base having spaced-apart first and second longitudinal edges and a top surface extending therebetween, and at least two generally dovetail shaped locking members being unitarily formed with and extending from said top surface of said base, wherein each said locking member is generally straight and parallel to at least one of said longitudinal edges, and wherein said locking members are spaced from said longitudinal edges.

4. A thermoplastic locking strip for being fused to a thermoplastic panel and for forming a connection for a curtain wall, said locking strip comprising an elongated rectangular base, said base having spaced-apart first and second longitudinal edges and a top surface extending therebetween, and at least two generally dovetail shaped locking members being unitarily formed with and extending from said top surface of said base, wherein each said locking member is generally straight and parallel to at least one of said longitudinal edges, said locking strip further comprising a first shoulder extending from said first longitudinal edge of said base, said first shoulder extending away from said top surface of said base, and said locking strip further comprising an attaching member extending from said first shoulder to define a free edge spaced from said first shoulder, said attaching member being parallel to said base.

5. A locking strip as in claim 4, wherein said attaching member is offset from said base.

6. A locking strip as in claim 4, wherein a J-shaped rim extends from said first shoulder having a first end joined to said first shoulder, an intermediate portion extending from said first end and away from said top surface of said base, and a stem extending from said intermediate portion, said stem being spaced from said base with a portion of said base being in face-to-face alignment with said stem, wherein said J-shaped rim, said first shoulder, and a portion of said base collectively define a channel extending coextensively with said base.

7. A locking strip as in claim 6 further comprising a second shoulder being unitarily formed with and extending from said second longitudinal edge of said base, said second shoulder extending away from said top surface of said base, and said locking strip further comprising a lip extending from said second shoulder away from said first shoulder, said lip being spaced from said base.

8. A locking strip as in claim 7, wherein said lip defines a thickness, said channel defines a width, said width being at least as great as said thickness.

9. A locking system for interconnecting two sections of a thermoplastic curtain wall, said locking system comprising:

first and second elongated thermoplastic locking strips, each said locking strip having a base with a top surface and two generally dovetail shaped locking members protruding from said top surface, and each said locking member having a first surface spaced from said base and two side surfaces extending between said base and said first surface, each said side surface defining an acute angle relative to said top surface of said base, wherein, with said first and second locking strips being in homogamous locked engagement, each said locking member of said first locking strip has at least one said side surface in face-to-face engagement with a single side surface of said second locking strip.

10. A locking system as in claim 9, wherein each said locking strip is formed to define a channel and an elongated lip, said channel being dimensioned to accommodate said lip, and wherein, with said first and second locking strips being in homogamous locked engagement, said lip of said first locking strip is disposed in said channel of said second locking strip, and said lip of said second locking strip is disposed in said channel of said first locking strip.

11. A locking system as in claim 9, wherein, with said first and second locking strips being in homogamous locked engagement, at least one bead of sealant material is interposed between said first and second locking strips.

12. A curtain wall system for lining a trench and for containing contaminated material therein, said system comprising:

first and second flat thermoplastic panels, each said panel having spaced-apart longitudinal edges;

a first locking strip fused in partial face-to-face engagement to said first panel, said first locking strip being formed with two generally dovetail shaped first locking members; and a second locking strip fused in partial face-to-face engagement to said second panel, said second locking strip being formed with two generally dovetail shaped second locking members, wherein said first and second locking strips are substantially identical in form and shaped to homogamously interlock with said first locking members being in dovetailed intermeshing engagement with said second locking members.

13. A curtain wall system as in claim 12, wherein, with said first and second locking strips being homogamously interlocked, at least one bead of sealant material is interposed between said first and second locking strips.

14. A curtain wall system as in claim 12, wherein each said locking strip is formed to define a channel and an elongated lip, said channel being dimensioned to accommodate said lip.

15. A curtain wall system as in claim 14, wherein, with said first and second locking strips being homogamously interlocked, said lip of said first locking strip is disposed in said channel of said second locking strip, and said lip of said second locking strip is disposed in said channel of said first locking strip.

* * * * *